US006496158B1

(12) United States Patent
Ksienski et al.

(10) Patent No.: US 6,496,158 B1
(45) Date of Patent: Dec. 17, 2002

(54) INTERMODULATION GRATING LOBE SUPPRESSION METHOD

(75) Inventors: David A. Ksienski, Los Angeles, CA (US); Gwendolyn M. Shaw, Torrance, CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 09/968,190

(22) Filed: Oct. 1, 2001

(51) Int. Cl.[7] ..... H01Q 3/02; H01Q 3/22
(52) U.S. Cl. ..... 343/853; 342/374; 370/204
(58) Field of Search ..... 343/853, 700 MS; 342/374, 372; 370/204, 209, 339, 343, 480; 375/267

(56) References Cited

U.S. PATENT DOCUMENTS 5,204,686 A * 4/1993 Petrelis et al. ..... 342/374
6,256,290 B1 * 7/2001 Ramesh ..... 370/204

* cited by examiner

*Primary Examiner*—Don Wong
*Assistant Examiner*—James Clinger
(74) *Attorney, Agent, or Firm*—Derrick Michael Reid

(57) ABSTRACT

A grating lobe suppression method is applied to a phased array antenna system having antenna array elements that are grouped in regularly spaced subarrays each having a plurality of regularly spaced antenna elements within the subarrays for suppressing intermodulation grating lobes generated within a field of view of the antenna system when amplifying two modulated carrier communication signals at respective two different frequencies.

9 Claims, 2 Drawing Sheets

SUBARRAY BEAM STEERING SYSTEM

REGULARLY SPACED ARRAY OF SUBARRAYS

FIELD OF VIEW ANTENNA PATTERN

SUBARRAY BEAM STEERING SYSTEM

INTERMODULATION GRATING LOBE SUPPRESSION METHOD

STATEMENT OF GOVERNMENT INTEREST

The invention was made with Government support under contract No. F04701-00-C-0009 by the Department of the Air Force. The Government has certain rights in the invention.

FIELD OF THE INVENTION

The invention relates to the field of antenna communication systems. More particularly, the present invention relates to phase array antenna systems communicating dual frequency signals generating intermodulation grating lobes.

BACKGROUND OF THE INVENTION

Communication systems use antennas for transmitting and receiving communication signals. The communication systems can use a variety of antenna systems having transmitter and receiver antennas for defining antenna gain patterns with maximas for directional transmitting and receiving the communication signals. One type of antenna system is the active transmit phased arrays having multiple directional antenna elements using beam steering. Typically, the phased array antenna has a plurality of individual antenna elements lying in plane. Each antenna element broadcasts one or more steered communication signals eliminating the need for multiple apertures. Each array element has a respective phase offset for each signal for steering the respective antenna beams in a desired direction toward communication receivers. The transmission of the multiple communication signals create unwanted intermodulation products in power amplifiers that produce gain patterns appearing as unwanted signal at intermodulation frequencies in secondary intermodulation main beams and grating lobes in the antenna gain pattern. Transmitter power amplifier linearizers and power back-off methods are used to reduce signal distortion. While solid state power amplifier linearizers and power back-off techniques can lower the levels of the unwanted intermodulation products, such techniques lower the array efficiency. It is desirable to control the phased array elements with grating lobe suppression for reduced signal distortion during signal transmission that may use saturated power amplifiers and linearization methods.

Active phased arrays have solid state power amplifiers at each array element. These solid state power amplifiers are nonlinear devices that produce the unwanted intermodulation products when multiple signals are introduced. The intermodulation frequencies are spaced according to the difference between the frequencies. For example, when two transmit carrier frequencies $f_1$ and $f_2$ are used for broadcasting signals with two primary main beams creating unwanted intermodulation frequencies at $2f_1-f_2$ and $2f_2-f_1$. The phased array produces antenna patterns at the intermodulation frequencies. The secondary intermodulation main beams of the intermodulation product patterns are steered according to the difference in the pointing angles of the primary main beams. Therefore, the phased array antenna field of view contains the two primary main beams and may contain intermodulation grating lobe beams depending on the difference in pointing angles of the two primary main beam patterns. When the primary main beams are closely spaced, then the secondary intermodulation main beams and intermodulation grating lobe beam may appear within the filed of view of the phase array antenna. When the primary main beams are widely spaced, then a special condition occurs where the secondary intermodulation main beams advantageously appear outside the field of view and the intermodulation grating lobe beams disadvantageously appear within the field of view. When the intermodulation grating lobe beam are in the field of view, then the intermodulation grating lobe beams are unwanted interference generated at the intermodulation frequencies. These and other disadvantages are solved or reduced using the invention.

SUMMARY OF THE INVENTION

An object of the invention is to provide a method for reducing interference generated at intermodulation frequencies.

Another object of the invention is to provide a method for suppressing intermodulation grating lobe beams at the intermodulation frequencies.

Another object of the invention is to provide a method for suppressing intermodulation grating lobes in phased array antenna systems.

Still another object of the invention is to provide a method for reducing transmitted interference signals generated at intermodulation frequencies.

Yet another object of the invention is to provide a method for suppressing intermodulation grating lobes in phased array antenna systems by regular spacing of phase array antenna elements.

The present invention is directed to a method for reducing the amplitude level of intermodulation grating lobes in the field of view of a phased array antenna system by regular spacing of subarrays each having a plurality of phased array antenna elements and by interposing predetermined regular spacing between the subarray antenna elements within each subarray. The secondary intermodulation main beams are disposed off of the field of view, but the remaining intermodulation grating lobes beams still appear within the field of view, but at suppressed amplitudes levels. The regular spacing of the subarrays and the regular spacing of the phased array antenna elements within each subarray reduces, that is, suppresses the intermodulation grating lobe beams that may appear in the field of view. These and other advantages will become more apparent from the following detailed description of the preferred embodiment.

DETAILED DESCRIPTION OF THE PREFERRED EMBODIMENT

Figure 1:
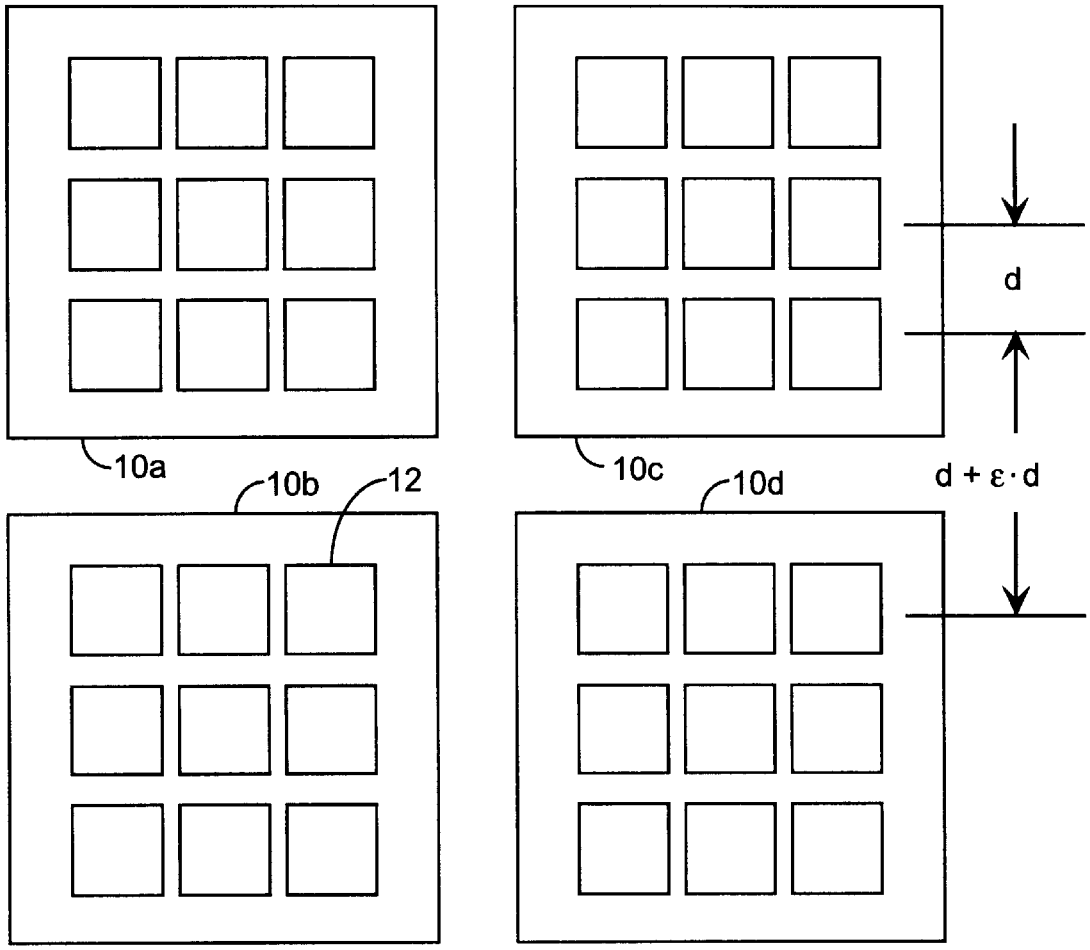
FIG. 1 is layout diagram of four subarrays of a phase array antenna system having a gapped array of subarrays.
Figure 2:
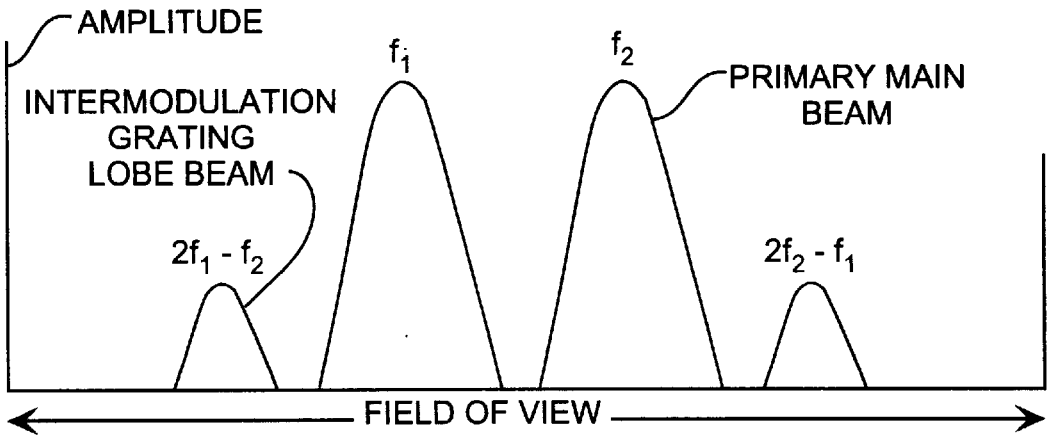
FIG. 2 is graph of the field of view antenna pattern of a phased array antenna having primary main beams and intermodulation grating lobe beams.

An embodiment of the invention is described with reference to the figures using reference designations as shown in the figures. Referring to FIGS. 1 and 2, a phased array antenna system is segmented into four regularly spaced subarrays 10*a*, 10*b*, 10*c*, and 10*d*, each having 3×3 regularly spaced antenna elements, one of which elements is designated as phased array antenna element 12, for a total of thirty six phased array elements arranged in quadrants. The subarray elements 12 are regularly evenly spaced with a spacing gap d between the elements within the each subarray 10*a* through 10*d*. The subarrays 10*a* through 10*d* are regularly spaced in the quadrants and having a gap between the quadrants at a spacing of a distance of d+ϵd with a gap of ϵd, whereas each of the antenna elements 12 are regularly spaced at the distance d within each subarray 10*a* through 10*d*.

The two carrier frequencies $f_1$ and $f_2$ are respectively used for communicating respective communication signals to two respective communications receivers, not shown. The phased array elements are phased for generating two primary main beams used to communicate respective communication signals having respective modulated carriers at the carrier frequencies $f_1$ and $f_2$. The use of the two frequencies $f_1$ and $f_2$ create transmitted interfering signals at intermodulation frequencies $2f_1-f_2$ and $2f_2-f_1$ appearing as intermodulation grating lobe beam. The intermodulation grating lobe beams are suppressed within a field of view of the phased array antenna system.

The primary main beams $f_1$ and $f_2$ are in the exemplar form steered off center of the field of view for communicating to respective receivers. The field of view may be a view of the earth from a geostationary communications satellite. The field of view may be, for example, eighteen degrees. The intermodulation grating lobe beams communicating interfering signals at the intermodulation frequencies $2f_2-f_1$ and $2f_1-f_2$ are a function of the spacing of the subarrays and the spacing of the phased array elements. The amplitude of the intermodulation grating lobes and consequently the amplitude of the interfering signals at the intermodulation frequencies $2f_2-f_1$ and $2f_1-f_2$ can be reduce when each array element is regularly spaced within the subarray and when there is a gap between the subarrays for regularly spacing the subarrays.

The amplitude a(θ,ϕ) defines the total antenna pattern of the entire array and is a function of the regular spacing of the subarrays and the regular space of the element of each subarray as defined by a beam pattern equation.

$$a(\theta,\phi)=a_{subarray}(\theta,\phi)\cdot a_{array}(\theta,\phi)$$

In the beam pattern equation, the term $a_{subarray}(\theta,\phi)$ indicates a subarray of elements. The term $a_{array}(\theta,\phi)$ indicates an array of elements where each element is a subarrays of antenna elements. The term a(θ,ϕ) is the array pattern of the regularly spaced array comprising the subarrays where the element of the $a_{array}(\theta,\phi)$ array are the subarrays. In the beam pattern equation, the angle θ is a coelevation angle off a vertical axis to an x-y plane of the phase array antenna, and, the angle ϕ is an azimuth angle in the x-y plane of the phased array antenna. The beam pattern equation can be used to compute the beam amplitude profile of any one of the primary main beams or the intermodulation grating lobe beams.

For a square or rectangular grid subarray, the $a_{subarray}(\theta,\phi)$ pattern is separable in the x and y axes as defined by subarray equations.

$$a_{subarray}(\theta,\phi)=a_x(\theta,\phi)\cdot a_y(\theta,\phi)$$

$$a_x(\theta,\phi)=\sum_{m=-M}^{M} I_m e^{jmkd(\sin\theta\cos\phi-\sin\theta_O\cos\phi_O)}$$

$$a_y(\theta,\phi)=\sum_{n=-N}^{N} J_n e^{jnkd(\sin\theta\sin\phi-\sin\theta_O\sin\phi_O)}$$

In the subarray equations, $a_x$ and $a_y$ are the patterns of x directed and y directed linear arrays, $I_m$ and $J_n$ are the excitations of the x directed and y directed linear arrays, k is the wave number equal to ω/c where ω is the carrier frequency such as $f_1$, $f_2$, $2f_1-f_2$ and $2f_2-f_1$ in radians and c is the speed of light, d is the interelemental spacing dimension, 2M+1 and 2N+1 are the number of elements in the x directed and y directed subarrays such as when M=N=1 for a 3×3 subarray, and $\theta_o$ and $\phi_o$ are the primary main beam pattern coelevation and azimuth angles. The subarray primary main lobe beams occurs when $\theta=\theta_o$ and $\phi=\phi_o$.

The Intermodulation grating lobes occur as defined by grating lobe equations.

$$\sin\theta_g\cos\phi_g-\sin\theta_o\cos\phi_o=\frac{\xi}{\frac{d}{\lambda}}$$

$$\sin\theta_g\sin\phi_g-\sin\theta_o\sin\phi_o=\frac{\eta}{\frac{d}{\lambda}}$$

In the grating lobe equations, ξ and η are integers enumerating an infinite number of possible grating lobes, $\theta_g$ and $\phi_g$ are the intermodulation grating lobe pattern angles, and λ is the intermodulation product wavelength where λ=2π/k. The array pattern is defined by an array pattern equation.

$$a_{array}(\theta,\phi)=4\cos\left[k\left(M+\frac{1}{2}+\frac{\varepsilon}{2}\right)d(\sin\theta\cos\phi-\sin\theta_o\cos\phi_o)\right]\cdot\cos\left[k\left(N+\frac{1}{2}+\frac{\varepsilon}{2}\right)d(\sin\theta\sin\phi-\sin\theta_o\sin\phi_o)\right]$$

In the array pattern equation, ϵ is the subarray gap factor. The product ϵd indicates the subarray gap size. The intermodulation grating lobe suppression method sizes the subarray gaps between the subarrays such that the array pattern has a null in the direction of the subarray intermodulation grating lobe when $\theta_n=\theta_o$ and $\phi_n=\phi_o$ according to a array pattern null equations.

$$\sin\theta_n\cos\phi_n-\sin\theta_o\cos\phi_o=\frac{\alpha\pm\frac{1}{4}}{\frac{d}{\lambda}\cdot\left(M+\frac{1}{2}+\frac{\varepsilon}{2}\right)}$$

$$\sin\theta_n\sin\phi_n-\sin\theta_o\sin\phi_o=\frac{\beta\pm\frac{1}{4}}{\frac{d}{\lambda}\cdot\left(N+\frac{1}{2}+\frac{\varepsilon}{2}\right)}$$

In the array pattern null equations, θn and $\phi_n$ are the array null pattern angles $\theta_g$ and ϕ, where α and β are integers enumerating an infinite number of possible nulls. Therefore, grating lobe suppression for a gap factor ϵ according to grating lobe suppression equations.

$$\varepsilon=\frac{2\alpha\pm\frac{1}{2}}{\xi}-(2M+1)$$

$$\varepsilon=\frac{2\beta\pm\frac{1}{2}}{\eta}-(2N+1)$$

The intermodulation grating lobes within the field of view are nearest the intermodulation main lobe when ξ=1 or η=1, M=N=1, and α=β=2. Consequently, the gap factor ϵ is sized to suppress the nearest intermodulation grating lobe beam in the field of view is $\epsilon d=d/2$, that is, when $\epsilon/2$ for a square grid of arrays. The phased elemental contribution to the intermodulation grating lobes tend to cancel each other in the direction of the intermodulation beam angles of $\theta_g$ $\phi_g$, and, the elemental contribution to the primary main beams tend to add in the direction $\theta_o$ and $\phi_o$, thereby effectively suppressing the intermodulation grating lobes as an effective null.

The method can be used in phased array antenna communication systems where the array transmits multiple signals in two or more steered beams. One application is a time division multiple accessing (TDMA) satellite communication system where the downlink beams are repositioned to different user locations at fixed time intervals. In this TDMA application, exploitation of the suppression method is through scheduling the beams to maximize beam separation. With maximized beam separation, the intermodulation product grating lobes that appear within the field of view will be suppressed. Another potential application is a scanning radar antenna where the beams are steered in a regular scan pattern. This scanning radar application of the suppression method can occur by starting the scanning beams at different parts of the scan pattern and thereby introducing a delay between the scans.

The method is applied for suppressing intermodulation grating lobes in phase array antenna systems. The technique places a gap between the subarrays and the array elements. The subarray gap size is preferably one-half the element spacing in X-Y directions. Suppression for most cases is approximately between 2.6 dB and 5.1 dB. The technique is useful for a special condition where the primary main beams are widely spaced and the intermodulation pattern grating lobes appear within the field of view. The array configuration places gaps between the subarrays to suppress intermodulation grating lobes in the field of view. The maximum element spacing is used to preclude the $\xi=2$ and the $\eta=2$ grating lobes from entering the field of view. The patterns of an exemplar 18×18 element array with uniform illumination have the intermodulation grating lobes steered into a 17° degree field of view. When the element placement patterns are with the regular gaps, the grating lobes in the field of view are reduced. A side effect of this grating lobe suppression method is that the sidelobes of the primary patterns increase by approximately 1.0 dB and the array efficiency is reduced on the order of 0.01 dB. In a first exemplar configuration, a array of 18×18 elements form four subarrays of 9×9 elements each. The element spacing is 2.4λ, with an intermodulation main beam angle $(\theta,\phi)_o$ respectively equaling 24.0° degrees and 11.25° degree, with $\xi=-1$, with $\eta=0$, having an edge-of-coverage angle of 8.0 degrees, with the grating lobe angle $(\theta,\phi)_g$ are respectively equal to 4.7° degrees and 102.6° degrees for providing 2.6 dB in suppression of the intermodulation products. In a second exemplar configuration, 18×18 elements form four subarrays of 9×9 elements each. The element spacing is 2.5λ., with intermodulation main beam angles $(\theta,\phi)_o$ respectively equal to 24.0° degrees and 45.0° degrees, with $\xi=-1$, with $\eta=-1$, having an edge of coverage angle is 8.0° degrees, with the grating lobe angles $(\theta,\phi)_g$ are respectively equal to 9.1° degrees and −135.0° degrees for providing 5.1 dB in suppression of the intermodulation products.

Figure 3:
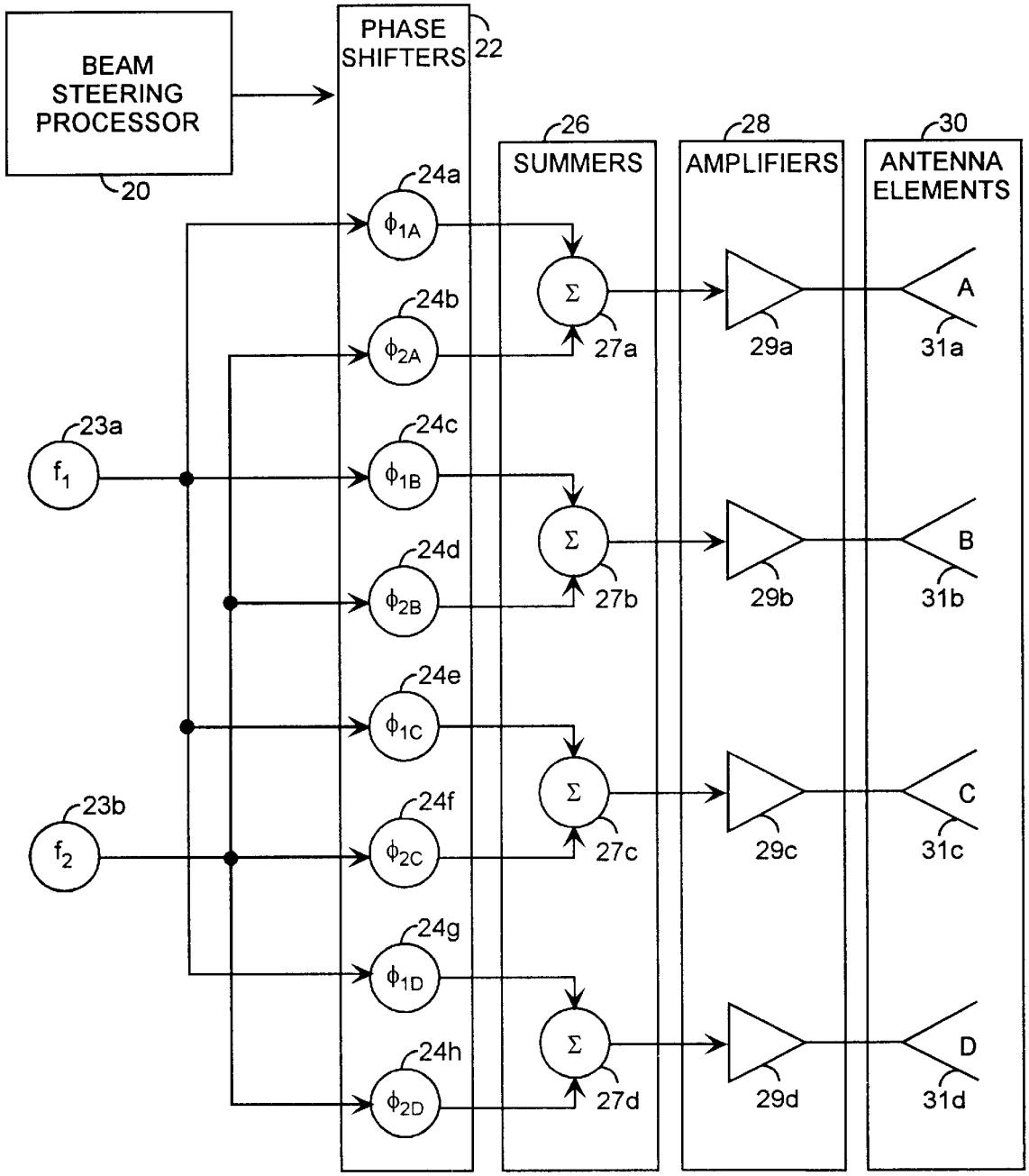
FIG. 3 is a schematic of a subarray beam steering system.

Referring to all of the figures, and more particularly to FIG. 3, a beam steering processor 20 conventionally controls a bank phase shifters 22 having a plurality of individual phase shifters 24*a*, 24*b*, 24*c*, 24*d*, 24*e*, 24*f*, 24*g*, and 24*h*. The two carrier frequencies $f_1$ and $f_2$ are modulated carrier signals 23*a* and 23*b*, respectively communicating data modulating the two carrier frequencies. The two modulated carriers 23*a* and 23*b* are fed into the phase shifters 22 to a plurality of pairs of phase shifters, for example, the pair of shifters 24*a* and 24*b* for providing respective phase shifted outputs. The phase shifted outputs are summed by a bank of summers 26 including individual summers 27*a*, 27*b*, 27*c* and 27*d*. Each pair of phase shifted outputs of the phase shifter 22, such as phase shifters 24*a* and 24*b*, are summed by the summer 26, for example, summer 27*a*, for providing dual carrier signals fed into a bank of amplifiers 28 having amplifiers 29*a*, 29*b*, 29*c*, and 29*d*. For example, summed modulated carrier signal from the summer 27 is amplified by amplifier 29*a*. The amplified carrier frequency signals from the amplifiers 28 are respectively communicated to the antenna elements 30 having elements 31*a*, 31*b*, 31*c* and 31*d*. For example, amplified modulated carrier signal from amplifier 29*a* is communicated to antenna element 31*a* for transmission. The antenna elements 30 collectively function to define the field of view of the antenna pattern, an example of which is shown in FIG. 2. The amplifiers 28 are not perfect amplifiers such that intermodulation products are produced when amplifying the modulated carrier signals $f_1$ and $f_2$. In practice, the regular spacing of the subarrays 10*a* through 10*d* with regular elemental spacing within each subarray serves to reduce the intermodulation grating lobes $2f_1-f_2$ and $2f_2-f_1$.

Active transmit phased arrays with two frequencies have intermodulation products that produce unwanted beams. Solid state amplifiers at each array element produce intermodulation products when two signals are introduced. The intermodulation main beam is steered according to the difference in the pointing angles of the primary main beams. The antenna field of view may contain an intermodulation main beam or an intermodulation grating lobe. The method places a gap between the subarrays such that the array pattern has a null in the direction of the subarray intermodulation grating lobe. The method takes advantage of existing subarray architectures. A gap between the subarrays is a modification of the elemental and subarray spacing within the array. The method is independent of wavelength and functions at all frequencies. The grating lobe suppression method can be used in array applications where the array transmits two frequencies in two or more steered beams. In TDMA satellite antenna applications, downlink beams are repositioned at fixed time intervals. The suppression method is used for scheduling beams to maximize beam separation. The intermodulation product grating lobes that appear within the field of view are suppressed. In scanning radar antenna application, beams are steered in a regular scan pattern. The suppression method can introduce a delay between the scans. The suppression method for intermodulation grating lobes takes advantage of gaps disposed between the subarrays. The gap size can be for example one-half the element spacing for grating lobe suppression. Those skilled in the art can make enhancements, improvements, and modifications to the invention, and these enhancements, improvements, and modifications may nonetheless fall within the spirit and scope of the following claims.

What is claimed is:

1. A method of suppressing intermodulation grating lobe beams in an antenna pattern in a field of view of a phase array antenna system of a plurality of antenna elements, the method comprising the steps of, regularly spacing the plurality of antenna elements into subarrays, each of the subarrays comprising a plurality of regularly spaced antenna elements of the plurality of antenna elements, regularly spacing the subarrays for generating a null in the antenna pattern in the field of view of the phased array antenna system, generating two modulated carrier signals respectively at a first carrier frequency and a second carrier frequency, phase shifting the two modulated carrier signals into respective first and second sets of phase shifted modulated carrier signals, summing the first and second sets of phase shifted modulated carrier signals into a plurality of summed modulated carrier signals, amplifying the plurality of summed modulated carrier signals into amplified modulated carrier signals, the amplifying of the plurality of the summed modulated carrier signals creating intermodulation products in the intermodulation grating lobe beams within the field of view, and transmitting through the plurality of antenna elements the two amplified modulated carrier signals, the regular spacing of the subarrays and the regular spacing of the antenna elements in each of the subarrays tending to cancel the intermodulation products for decreasing the intermodulation grating lobe beams by effectively positioning the null upon intermodulation grating lobe beams.

2. The method of claim 1 wherein the transmitting step, the amplified modulated carrier signals respectively appear within a field of view of the antenna system as first and second primary main beams respectively having modulated first and second carriers signals respectively at the first and second carrier frequencies, and the intermodulation products appear within the field of view of the antenna system as first and second suppressed intermodulation grating lobe beams.

3. The method of claim 1 wherein the regularly spacing step comprising the steps of, subarray spacing of the subarrays with equal spacing in X-Y directions, and elemental spacing of the antenna elements with equal spacing in X-Y directions.

4. The method of claim 1 wherein, the regular spacing between the antenna elements is an element spacing distance d, and the regular spacing between the subarray is defined by a subarray gap $\epsilon d+d$.

5. The method of claim 1 wherein, the regular spacing between the antenna elements is an element spacing distance d, the regular spacing between the subarray is defined by a subarray gap $\epsilon d+d$, and a subarray spacing factor $\epsilon$ is equal to ½.

6. The method of claim 1 wherein, the regular spacing between the antenna elements is an element spacing distance d, the regular spacing between the subarray is defined by a subarray gap $\epsilon d+d$, a spacing factor $\epsilon$ is equal to ½, and the spacing distance d and the spacing factor $\epsilon$ tending to create the null in the antenna pattern at the field of view position of intermodulation grating lobe beams by signal cancellation of the intermodulation products transmitted by the antenna elements.

7. The method of claim 1 wherein the first and second carrier modulated signals producing first and second primary main beams transmitted by the plurality of antenna elements, the first and second primary main beams, and, the phase shifting step serving to space the primary main beams within the field of view, the spacing of the primary main beams within the field of view serving to dispose secondary intermodulation main beams outside the field of view and serving to dispose the intermodulation grating lobe beams within the field of view.

8. A method of suppressing intermodulation grating lobe beams in an antenna pattern in a field of view of a phased array antenna system of a plurality of antenna elements, the method comprising the steps of, regularly spacing the plurality of antenna elements into subarrays, each of the subarrays comprising a plurality of regularly spaced antenna elements of the plurality of antenna elements, regularly spacing the subarrays for generating a null in the antenna pattern in the field of view of the phased array antenna system, generating two modulated carrier signals respectively at a first carrier frequency and a second carrier frequency, the first and second carrier modulated signals producing first and second primary main beams transmitted by the plurality of antenna elements, the first and second primary main beams appearing in the field of view, phase shifting the two modulated carrier signals into respective first and second sets of phase shifted modulated carrier signals, the phase shifting serving to space the primary main beams within the field of view, the phase shifting also serving to dispose secondary intermodulation main beams outside the field of view and serving to dispose the intermodulation grating lobe beams within the field of view, summing the first and second sets of phase shifted modulated carrier signals into a plurality of summed modulated carrier signals, amplifying the plurality of summed modulated carrier signals into amplified modulated carrier signals, the amplifying of the plurality of the summed modulated carrier signals creating intermodulation products of the intermodulation grating lobe beams within the field of view, and transmitting through the plurality of antenna elements the two amplified modulated carrier signals, the regular spacing of the subarrays and the regular spacing of the antenna elements in each of the subarrays tending to cancel the intermodulation products for decreasing the intermodulation grating lobe beams by effectively positioning the null upon intermodulation grating lobe beams within the field of view.

9. The method of claim 8 wherein, the regular spacing between the antenna elements is an element spacing distance d, the regular spacing between the subarray is defined by a subarray gap $\epsilon d+d$, a spacing factor $\epsilon$ is equal to ½, and the spacing distance d and the spacing factor $\epsilon$ tending to create the null in the antenna pattern at the field of view position of intermodulation grating lobe beams by signal cancellation of the intermodulation products transmitted by the antenna elements.

* * * * *